United States Patent [19]

Siker

[11] 4,049,479

[45] Sept. 20, 1977

[54] METHOD OF INSTALLING DECALS ON VERTICALLY RIBBED TRAILER BODIES

[76] Inventor: Stephen J. Siker, 39 Park Ave., Randolph, N.J. 07801

[21] Appl. No.: 773,056

[22] Filed: Feb. 28, 1977

[51] Int. Cl.[2] ..... G09F 7/16

[52] U.S. Cl. ..... 156/71; 40/125 A; 40/129 C; 40/140; 156/202; 156/256; 428/78; 428/914

[58] Field of Search ..... 156/250, 256, 71, 202; 40/125 R, 125 F, 125 E, 129 C, 125 A, 140, 142 R; 428/78, 914

[56] References Cited

U.S. PATENT DOCUMENTS

| | | | |
|---|---|---|---|
| 3,740,882 | 6/1973 | Lanphere et al. | 40/129 C |
| 3,958,350 | 5/1976 | Garson | 40/129 C |

*Primary Examiner*—Edward G. Whitby
*Attorney, Agent, or Firm*—H. Hume Mathews

[57] ABSTRACT

A method of installing decals on vertically ribbed trailer bodies in which a decal having a self adhesive surface is first affixed as a flat or planar, undistorted sheet to the outer flat surfaces of the ribs on the trailer body so that the decal contacts only the outer surfaces of the ribs and is spaced from the outer surface of the trailer body at the locations between the ribs, slitting the decal vertically along a line spaced longitudinally from an outside corner of one of said ribs, similarly slitting said decal along a line spaced from an outside corner of a rib adjacent said first named rib to provide an intermediate decal portion which is cut off from the rib portions of the decal affixed to the ribs and which is of a length corresponding to the distance between the flanges of the two adjacent ribs, and affixing the cut off intermediate portion of the decal to the outer surface of the trailer body intermediate said ribs and the rib portions of the decal to the outer and side walls of each rib, leaving the flange portions thereof exposed.

3 Claims, 4 Drawing Figures

METHOD OF INSTALLING DECALS ON VERTICALLY RIBBED TRAILER BODIES

BACKGROUND OF THE INVENTION

Decals have been used for many years as one of the main forms of portraying graphics on truck bodies and truck trailers used in the trucking market. Large sums of money are spent each year in the application of signs, including decals, as a means of identification and advertising on truck bodies and trailers which travel the nation's highways each day.

Such decals historically have been designed to adapt to each different truck or trailer surface. For example, a standard undistorted decal can be applied, with satisfactory results, simply by affixing the same to the outer wall surface of a fiberglass trailer (FRP) which has a smooth, relatively flat skin, and to the outer wall surface of trailers having corrugated outer surfaces formed by horizontal identations on the sub-straight. But undistorted decals affixed to the outer surfaces of exterior post trailers (which have vertical reinforcing posts or ribs secured to the outer surface of the trailer side walls) are distorted by the uneven surface to such an extent, and in such a way, as to result in an unacceptable final appearance. Therefore, decals for application to exterior post trailers have in the past been deliberately distorted as originally prepared in such a way as to compensate for the distortion that occurs in applying the flat sheet decal to the uneven, "waved" surface of the ribbed trailer wall. Application of a distorted decal to such a wall can result in an undistorted looking sign after application if the sign before application is prepared with a built-in distortion that will compensate for, or counteract, the distortion that results from application to the uneven surface. As an alternative, an undistorted sign could be pre-cut into pieces, or sections, using expensive die cutting equipment at the point of sign manufacture, each of the pre-cut pieces being separately installed, piece by piece, on the trailer wall surface in such a way as to provide an installed sign relatively free of distortion.

However, both of these prior attempts to solve the problem of installing decal signs on the side walls of vertically ribbed trailers were expensive in that they required much time and labor in preparation of the decal and/or in its installation. According to the present invention, a new method has been discovered for installing quickly and with a minimum amount of labor, undistorted decals which can be prepared at minimum cost, and which after installation, according to the invention, will remain substantially free of distortion in the final appearance.

SUMMARY OF THE INVENTION

According to the present invention, the problems, as mentioned above, which exist in the prior art preparation and installation of signs, such as decals, on ribber trailer bodies are solved by (i) first preparing a decal having the same shape, size and lettering, or other graphics, as would be used if the said decal were to be installed on a flat or planar, unribbed surface; in other words, the decal so prepared is not distorted in any way, nor are the lettering or graphics thereon distorted; (ii) the said decal is then affixed while in flat or planar, uncut from to only the flat outer surfaces of the ribs of the trailer body, with those portions of the decal between the ribs being free of, and spaced from, the outer surfaces of the trailer wall lying between the ribs, and (iii) the decal, while held in position by the bond between the decal and each outer rib surface, is slit to provide portions which are folded over and affixed to the side surfaces of each rib and other portions which are subsequently affixed to the outer wall surfaces of the trailer body lying between the ribs.

The final result is a decal affixed simply and easily both to the ribs of the trailer body and to the intermediate wall portions of the trailer body lying between the ribs, which decal is both before installation and after installation undistorted, both in its initial preparation and in final appearance.

The decal of the present invention will, after installation by the method of this invention, have small vertically extending gaps adjacent to each side of each rib, through each of which gaps a portion of a rib surface will be exposed (the riveted rib flange). However, I have found that these gaps do not distract an observer of the graphics on the decal when they are observed as a whole, particularly by an observer of the vehicle while it is moving. The final result, even with the gaps present, is substantially the same as if a single, undistorted, one-piece decal were affixed to a flat or planar (unribbed) exterior trailer wall surface.

BRIEF DESCRIPTION OF THE DRAWINGS

FIG. 1 includes, in the dotted circle, an enlarged partial view of one of the rib sections, after installation of the decal thereon.

DETAILED DESCRIPTION OF A PREFERRED EMBODIMENT OF THE INVENTION

Figure 1:
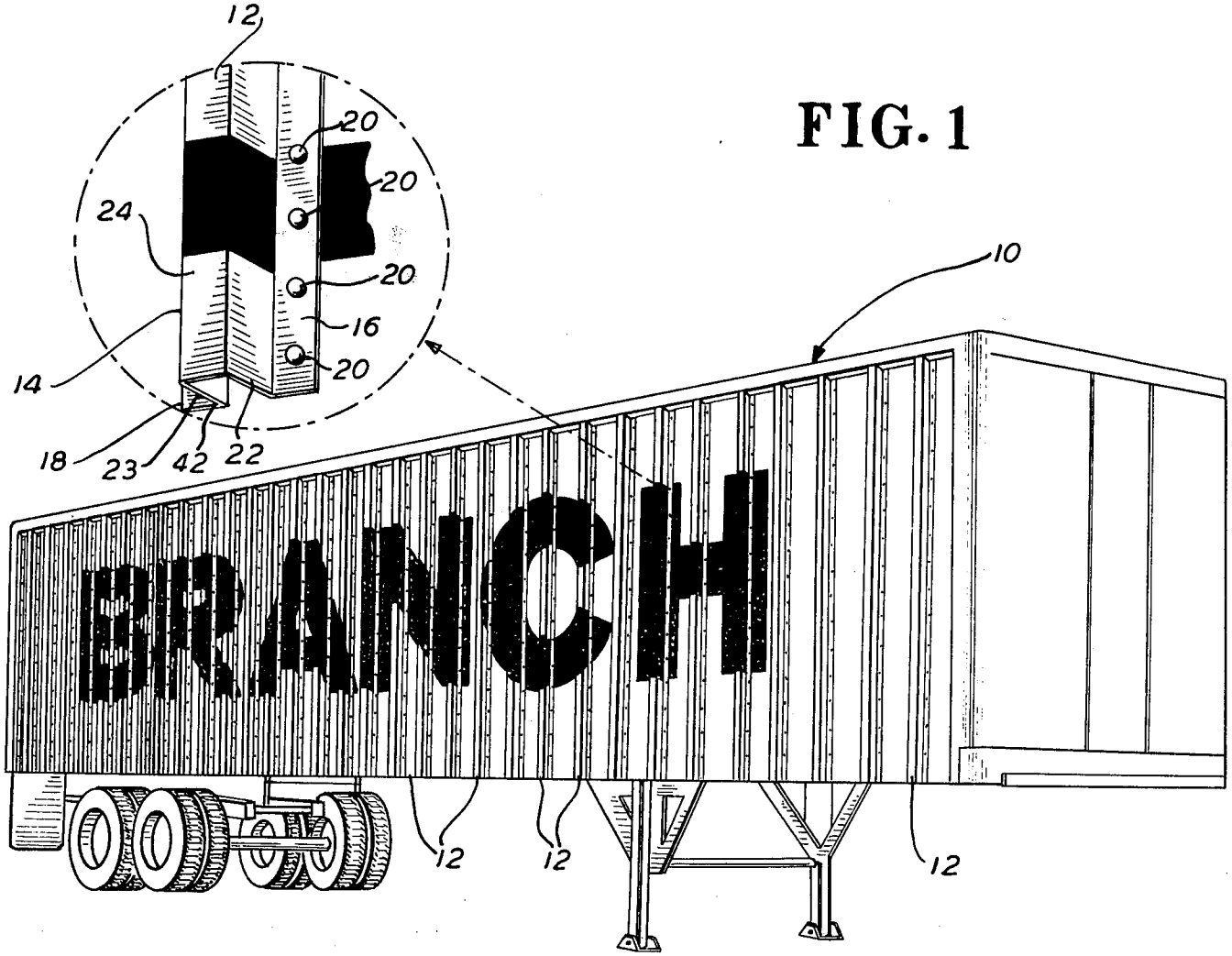
FIG. 1 is a perspective view of an exterior post trailer provided with a decal on a side wall thereof, installed by the method of the present invention.
Figure 2:
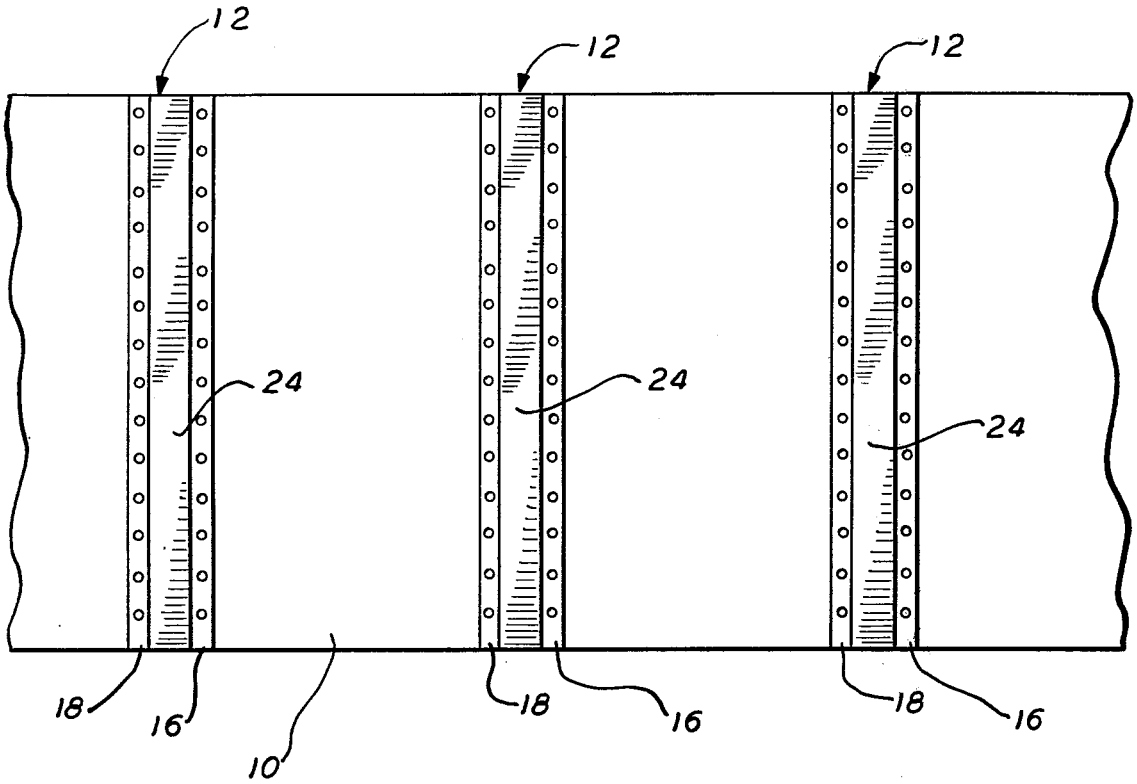
FIG. 2 is a partial elevation of a portion of the trailer wall of FIG. 1, prior to application of the decal.
Figure 3:
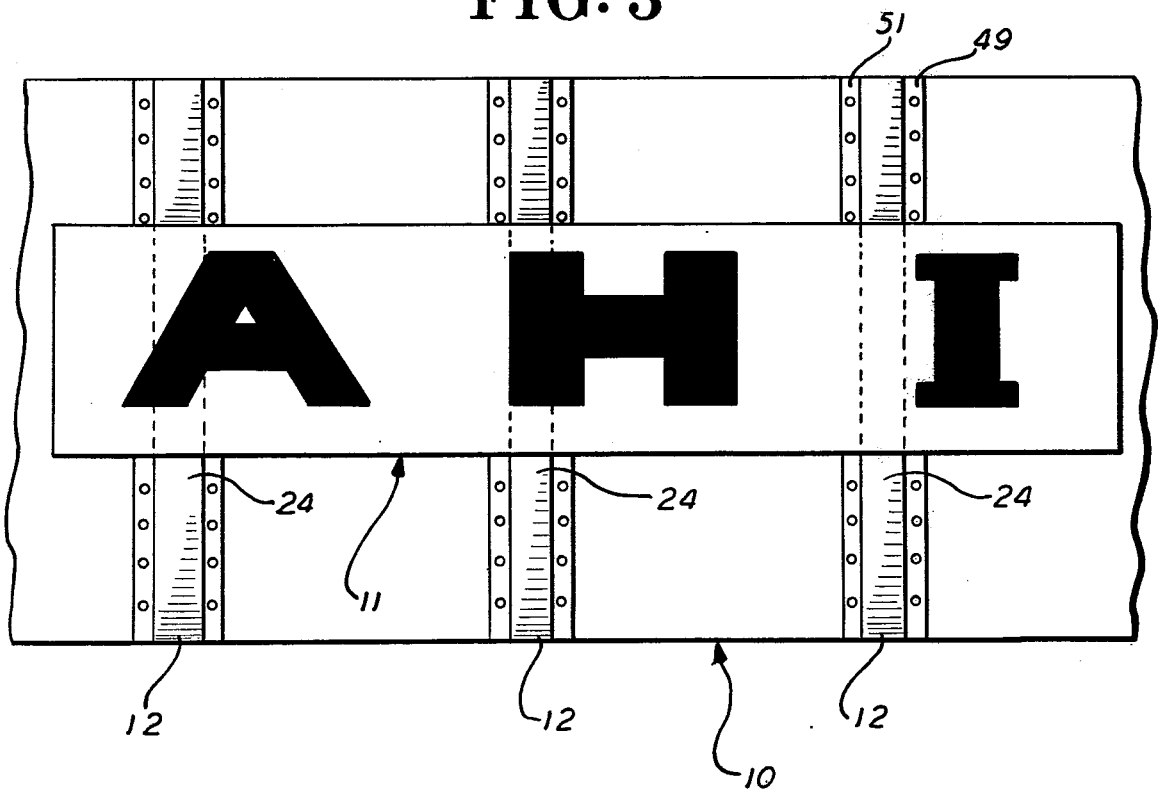
FIG. 3 is a partial elevation as in FIG. 2, but with a decal (in this case bearing different graphics than those shown in FIG. 1), affixed to the outer surfaces of three ribs, representing the initial step of the method of this invention.

In the embodiment of the invention as illustrated in the drawing, trailer body 10 in FIG. 1, having the usual vertically extending reinforcing ribs 12, has applied to the vertically ribbed side wall thereof a decal having any selected graphic thereon which, in this instance, is shown in FIG. 1 as the letters BRANCH, and in the case of FIG. 3, the letters AHI.

The vertical ribs are provided for reinforcement of the trailer side walls. As shown in the enlarged sectional view within the dotted circle of FIG. 1, each consists of two flanges 16 and 18, which lie in a plane parallel to the trailer side wall and which are riveted by the rivets 20 to the trailer side wall. Each rib also has a pair of parallel side walls 22 and 23, lying in planes extending outwardly from the trailer side wall. The rib side walls are joined by an outer flat wall 24, lying in a plane parallel to the trailer side wall but spaced outwardly therefrom by a distance equal to the depth of the rib.

The ribs on the trailer body are all of equal depth. They are equally spaced longitudinally along the entire length of the trailer side wall, as shown in FIG. 1.

In applying the decal 11 to this ribbed surface according to the present invention, the first step is to prepare a sheet form decal in undistorted form, i.e., the graphics of the decal as illustrated by the letters AHI in FIG. 3 are formed of exactly the same shape and dimensions that they normally would have if prepared for portrayal on a flat, as distinct from a ribbed, surface. The decal is preferably in one piece but can, particularly in the case of very large decals, be made in pieces, as determined by the side limits of the manufacturing equipment.

The undistorted decal is then, as a first step, affixed to the outer flat walls 24 of the ribs 12, as shown in FIG. 3. The decal, which is a relatively thin sheet of plastic (usually polyvinyl chloride) having a pressure sensitive adhesive backing, is of the type that can be permanently secured in place merely by placing the decal in the desired position relative to the trailer side wall and then pressing it in place. After the decal is positioned as desired relative to the trailer side wall, as shown in FIG. 3, it is pressed into close contact with the flat outer surfaces of each outer wall of the underlying ribs, so as to be permanently affixed thereto. After this step is completed the decal will be in the form of a flat, planar sheet affixed to the outer rib walls only, and spaced from the trailer wall at locations intermediate the ribs 12.

Figure 4:
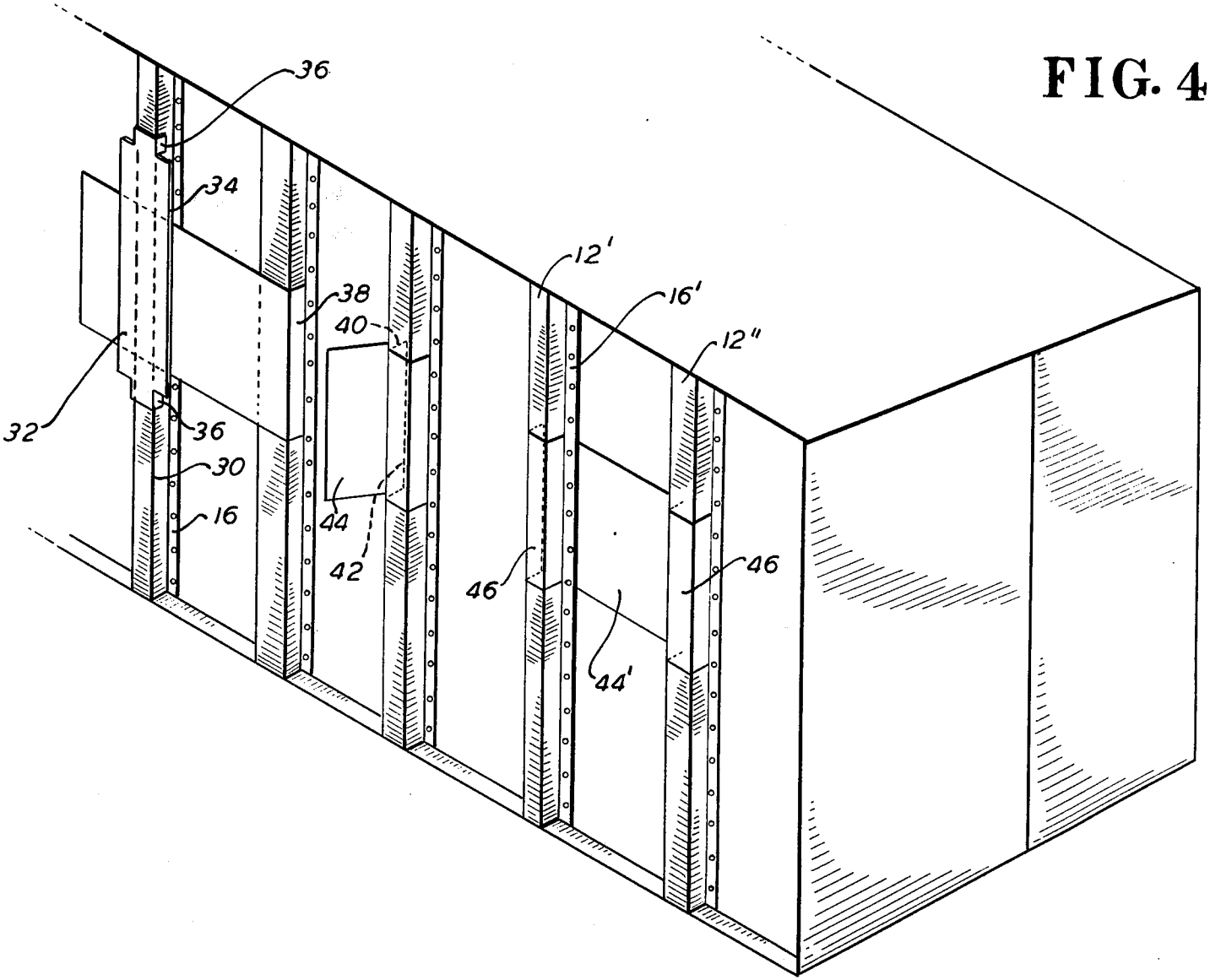
FIG. 4 is a partial perspective view of a trailer body of FIGS. 2 and 3, showing the further steps which are carried out according to the method of this invention for completing the application of the decal of FIG. 3 to the ribbed trailer body.

The second step of the method of the invention is to slit the decal along a vertical line spaced from an outer corner 30 of one of the ribs to which the decal is affixed, at a distance from said outer corner which corresponds to the width of the flange 16 of the said rib. This can be done, for example, as shown in FIG. 4, using a slitting guide 32 having a straight edge portion 34, which guides the cutting tool as it is moved to cut the decal along the said vertical line provided by the straight edge. The slitting guide has four ears, two of which bear against one side wall of the rib as shown at 36 in FIG. 4, and the other two of which (not shown) bear against the other side wall of the rib, thus positioning the guide relative to the rib so that the slit in the decal formed by the cutting tool will not only be vertical but also will be spaced at the proper distance from the adjacent rib corner.

Next, that portion of the decal between the slit and the rib corner is folded over the side wall of the rib and affixed thereto by pressure, as shown at 38 in FIG. 4. The width of the rib flanges 16 and 18 is normally the same as the width of the rib side walls 22 and 23. When this is the case, and the decal is slit as described above, the folded over portion of the decal will cover the rib side wall but will not overlap the flange.

Fourth, the intermediate portion of the decal between the said first named rib and the next adjacent rib is then folded over and affixed to the side wall of the second named rib, as shown at 40 in FIG. 4.

Fifth, a slit is made along the inside rib corner 42 so as to provide a first decal portion which is affixed to both side walls and the outer flat surface of the rib and an intermediate panel portion 44.

Sixth, the intermediate panel portion 44 is then pressed and affixed to that part of the outer wall of the trailer body intermediate the riveted flange portions of adjacent ribs, as illustrated at the right hand side of FIG. 4. As finally installed the sign consists of a continuous series of sections, one of which is illustrated at the right hand side of FIG. 4. Each such decal section has a decal portion 46 covering the ribs 12' and 12'' (excepting the rib flanges) and an intermediate decal portion 44' of the trailer wall, lying between the flanges of the adjacent ribs 12' and 12''.

After completion of installation of the decal according to the method of this invention the flanges 16, 18 of each rib will not be covered by the decal but rather will be exposed to view. All other surfaces of the ribs and the trailer side wall lying within the boundaries of the decal will be covered by the decal, permanently attached thereto by its pressure sensitive adhesive backing.

FIG. 4 is presented merely to show the various steps of the method and does not represent a completed installation. After the installation is completed in accordance with the various steps illustrated in FIG. 4, and in accordance with the description set forth above, the final result will be as illustrated in FIG. 1. As will be seen from inspection of FIG. 1, which is a representation of an undistorted decal installed on a vertically ribbed trailer wall according to the method of this invention, there is little or no distortion in the final appearance of the graphics, even though portions of the decal are wrapped around the rib walls. It is believed that the eyes of an observer, particularly when looking at a moving vehicle, tend to "see" the graphics as a whole, rather than in individual sections and when regarded as a whole, including the exposed areas of the riveted rib flanges, the decal in fact appears undistorted, easily readable and attractive in appearance.

I claim:

1. Method of applying graphics to a ribbed wall of a trailer body comprising, positioning an undistorted flexible sheet bearing said graphics in a selected location relative to said trailer wall and fixing said flexible sheet in said location by securing a portion of the same to the outer surface of a trailer rib, cutting said sheet to provide a portion which is folded over and affixed to a side wall of said rib, folding over and affixing to another rib side wall another portion of said sheet, cutting said sheet to provide a separate intermediate portion free of the sheet portion affixed to said rib, and securing the intermediate portion of the sheet to that portion of the trailer wall which lies between the flange portions of adjacent ribs.

2. Method of applying graphics to a ribbed wall of a trailer body comprising, positioning an undistorted flexible sheet bearing said graphics in a selected location relative to said trailer wall and affixing said flexible sheet in said location by securing a portion of the same to the outer surface of a trailer rib, cutting said sheet to provide a first portion which is folded over and affixed to a side wall of said rib and a second portion which is to be affixed to the intermediate section of the trailer wall lying between adjacent ribs, cutting said sheet a second time to free said second portion of said sheet from that part of the sheet which is to be affixed to the next adjacent rib, and affixing the thus freed second portion to that section of the trailer wall lying between said ribs.

3. Method of installing an undistorted decal having a pressure sensitive adhesive backing to a side wall of a trailer having vertically extending reinforcing ribs, comprising, placing the decal in the desired position relative to the trailer wall surface, securing the decal to at least some of the outer wall surfaces of the ribs underlying the decal while maintaining the decal in substantially flat, planar form so that those portions of the decal which lie between adjacent ribs are spaced from the surface of the trailer wall, slitting said decal vertically along a line adjacent an outer corner of one of said ribs and at a distance from said corner approximately equal to the width of the rib flange, similarly slitting said decal along a vertical line adjacent a rib corner of an adjacent rib, securing the panel portion of the decal freed by said second slit to the intermediate portion of the trailer side wall lying between the flanges of adjacent ribs, and repeating the said steps with respect to additional ribs on the trailer wall until the entire decal has been so installed as to provide the complete graphic.

* * * * *